US008723430B2

(12) United States Patent
Lucz et al.

(10) Patent No.: US 8,723,430 B2
(45) Date of Patent: May 13, 2014

(54) USING TWO THERMAL SWITCHES TO CONTROL A HYBRID LAMP

(75) Inventors: Peter Lucz, Budapest (HU); Laszlo Bankuti, Budapest (HU); Qi Long, ShangHai (CN); Devin Sun, ShangHai (CN)

(73) Assignee: General Electric Company, Schenectady, NY (US)

( * ) Notice: Subject to any disclaimer, the term of this patent is extended or adjusted under 35 U.S.C. 154(b) by 0 days.

(21) Appl. No.: 13/696,657

(22) PCT Filed: Oct. 27, 2011

(86) PCT No.: PCT/CN2011/081425

§ 371 (c)(1), (2), (4) Date: Nov. 7, 2012

(87) PCT Pub. No.: WO2013/060007

PCT Pub. Date: May 2, 2013

(65) Prior Publication Data

US 2013/0229118 A1 Sep. 5, 2013

(51) Int. Cl.

| | |
|---|---|
| ***H05B 35/00*** | (2006.01) |
| ***H05B 37/00*** | (2006.01) |
| ***H05B 39/00*** | (2006.01) |
| ***H05B 41/00*** | (2006.01) |
| ***H05B 41/232*** | (2006.01) |
| ***H01J 61/52*** | (2006.01) |

(52) U.S. Cl.

CPC ..... *H05B 35/00* (2013.01); *H05B 41/232* (2013.01); *H01J 61/523* (2013.01)

USPC ..... 315/182; 315/92; 315/116; 315/178; 315/309

(58) Field of Classification Search

None

See application file for complete search history.

(56) References Cited

U.S. PATENT DOCUMENTS

2011/0234094 A1* 9/2011 Wursching et al. ..... 315/51
2011/0241561 A1* 10/2011 Chitta et al. ..... 315/287

* cited by examiner

*Primary Examiner* — Anh Tran

(74) *Attorney, Agent, or Firm* — Fay Sharpe LLP

(57) ABSTRACT

A lamp assembly provides both instant light through use of an incandescent/halogen light/lamp source and an energy saving type light provided by a compact fluorescent light/lamp source. Both light sources are enclosed within a common envelope or outer bulb. First and second thermal sensors are provided in the lamp envelope at spaced locations to monitor the temperature of the lamp. When the sum of these two temperatures reaches a preselected value, power to the incandescent lamp source is terminated. Alternatively, when the difference these two temperatures reaches a preselected value, power to the incandescent lamp source is terminated.

20 Claims, 2 Drawing Sheets

USING TWO THERMAL SWITCHES TO CONTROL A HYBRID LAMP

BACKGROUND OF THE DISCLOSURE

This disclosure is directed to a lamp assembly, such as a lamp assembly that provides energy savings and also provides for instant light.

One proposed solution to reducing the time to full light while still obtaining the benefits of an energy savings lamp is to combine two lamps in one unit, sometimes referred to as a hybrid lamp. More particularly, a compact fluorescent lamp (CFL) and a conventional incandescent lamp are combined. Although it has been suggested to simultaneously turn on both lamps in order to result in instant light from the incandescent lamp, and then subsequently terminate or switch off the incandescent lamp to obtain the benefits of the energy efficient CFL, these known arrangements do not provide an efficient and effective manner for determining when to shut off the incandescent lamp, i.e., using the compact fluorescent lamp exclusively once the CFL has warmed up.

Before preheating is complete, there is no light emission from the CFL lamp. Once the arc discharge is initiated, the compact fluorescent lamp (CFL) still requires an additional approximately 20 to 120 seconds or more to reach full light output. During this warm-up period, there is a need for light and this is provided by the secondary light source, which in most instances is an incandescent lamp source. Once the CFL has reached full light output, there is no longer any need to operate the secondary lamp source. Therefore, when to switch off the secondary incandescent lamp source presents a challenge.

In one solution, it has been suggested that a thermally sensitive element be located in the lamp assembly, for example in the ballast compartment, to indicate when the CFL has reached a temperature indicative of sufficient light output after start-up. Unfortunately, this solution does not always provide an accurate assessment of the actual thermal conditions of the discharge vessel. Further, locating a thermally sensitive element in a lamp assembly is potentially impacted by temperature variations caused by different positions of the lamp e.g. vertically upright, horizontal, or inverted.

Likewise, other indirect factors can impact and are potentially inaccurate in defining when the light output of the primary light source (CFL) has stabilized. For example, the time to switch off the secondary or incandescent lamp source can be influenced by a random switching cycle, ambient temperature, indoor versus outdoor use, etc. As a result, the use of a single thermally sensitive element does not provide an accurate representation of the heat conditions nor does the thermal sensor necessarily provide an accurate indicator of when to terminate operation of the secondary or incandescent lamp source.

Still another proposed solution regarding when to terminate the incandescent lamp is to apply power to the incandescent lamp for a preselected time period. Again, this solution is not sufficiently accurate since various conditions may suggest a different time period, either shorter or longer.

Consequently, a need exists for a long-life compact fluorescent lamp that provides energy savings with instant light capabilities, and overcomes the problems noted with regard to turning off the secondary or incandescent light source once the more efficient, energy savings CFL source has reached full light output.

SUMMARY OF THE DISCLOSURE

A lamp assembly of the present disclosure provides for instant light, and is also an energy saving lamp that advantageously uses two light sources in a single outer bulb that more accurately determines when to shut off the secondary, instant light source.

The sensor member includes two thermal switches disposed in the envelope at spaced apart locations for reliably detecting the temperature of the discharge lamp, e.g., when the discharge lamp has reached a predetermined percentage of full light output (such as 50-60% of full light output).

The preferred lamp assembly includes a lamp base having a compartment. A first or fluorescent light or lamp source (efficient, long warm-up) and a second or incandescent light or lamp source (instantaneous light output, less efficient) are each mounted to the lamp base. An envelope of the lamp assembly forms a cavity around at least the fluorescent and incandescent lamp sources. A power control module preferably received in a lamp base compartment is operatively connected to the lamp sources. The thermal sensor members monitor a temperature of the lamp assembly at two different locations so that a more accurate determination regarding whether to terminate power supplied to the incandescent lamp source can be made.

The thermal sensor members are located at spaced, different locations in the lamp assembly. For example, the thermal sensor members may be located at opposite ends of the lamp assembly, or may be in a middle/central location and adjacent the outer envelope of the lamp assembly.

The secondary or incandescent lamp can be switched off when the sum of the temperatures of the two thermal switched reaches a preselected value. Alternatively, the second lamp can be switched off when the difference between the measured values reaches a preselected value.

A method of assembling a lamp assembly includes providing a lamp base, mounting a primary or fluorescent light or lamp source to the base, positioning a secondary or an incandescent light or lamp source adjacent the fluorescent lamp source, enclosing at least the fluorescent lamp source and the incandescent lamp source in a common envelope or bulb, and locating first and second thermal detectors in the bulb at spaced locations to monitor lamp temperature of the primary lamp source.

The method further includes providing a power control module for selectively terminating power to the incandescent lamp source in response to a predetermined temperature value of the lamp assembly.

The method includes using one of the sum or the differences of the temperatures of the two thermal switches so that when a predetermined value is reached, the secondary lamp is switched off.

A primary benefit of the present disclosure is the ability to provide instant light in an energy saving lamp assembly.

Another benefit resides in that both light sources are initially energized to provide instant light, then the secondary, incandescent lamp source is shut off once the primary, fluorescent lamp source reaches full light output.

Still another benefit is associated with monitoring the temperature in order to assure that a preselected percentage of full light output has been reached before shutting off the secondary lamp source.

Still other benefits and advantages of the present disclosure will become apparent upon reading and understanding the following detailed description.

DETAILED DESCRIPTION OF THE PREFERRED EMBODIMENTS

Figure 1:
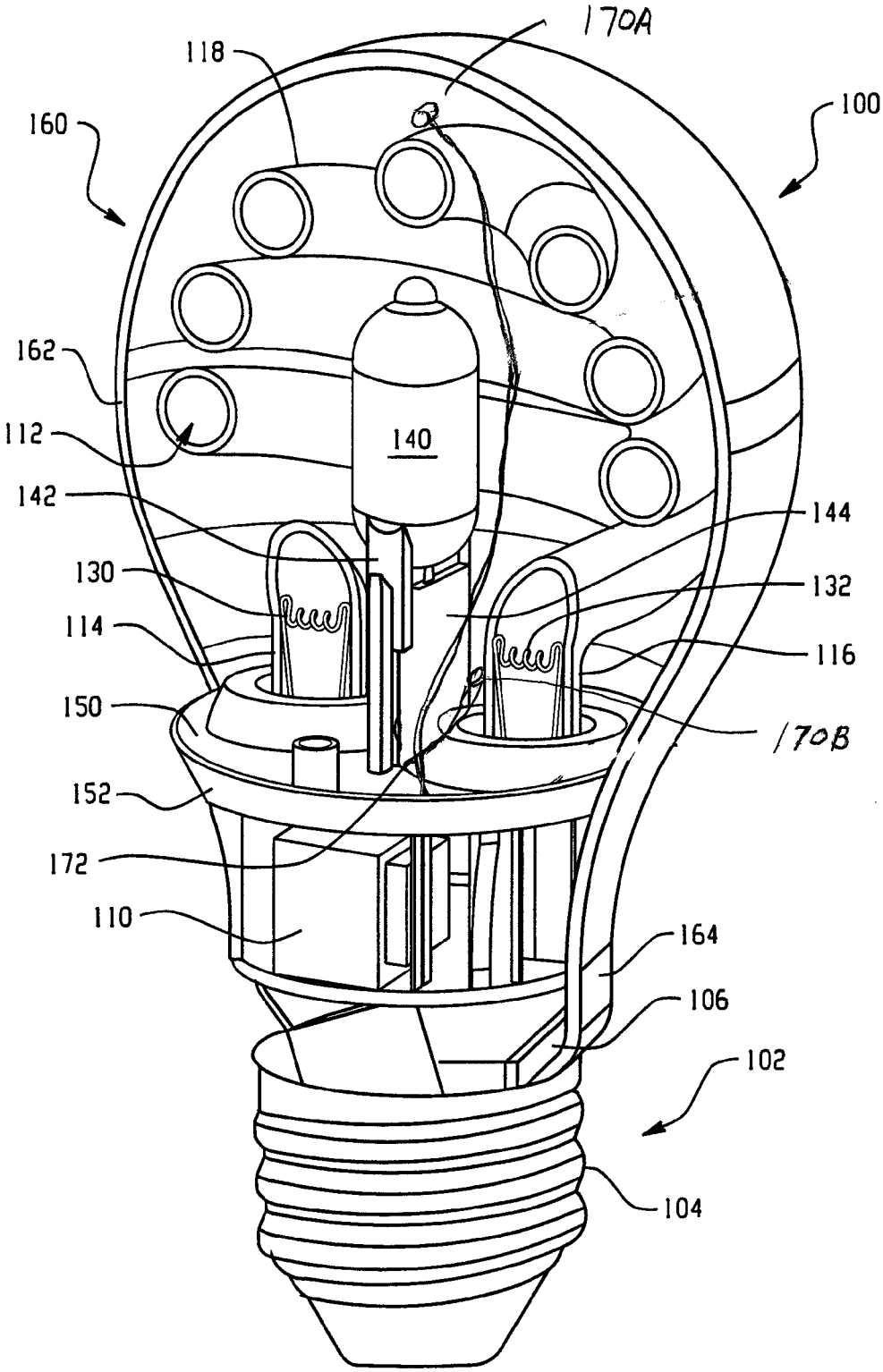
FIG. 1 is an elevational view of the lamp assembly, with portions of the bulb and fluorescent lamp source in cross-section.
Figure 2:
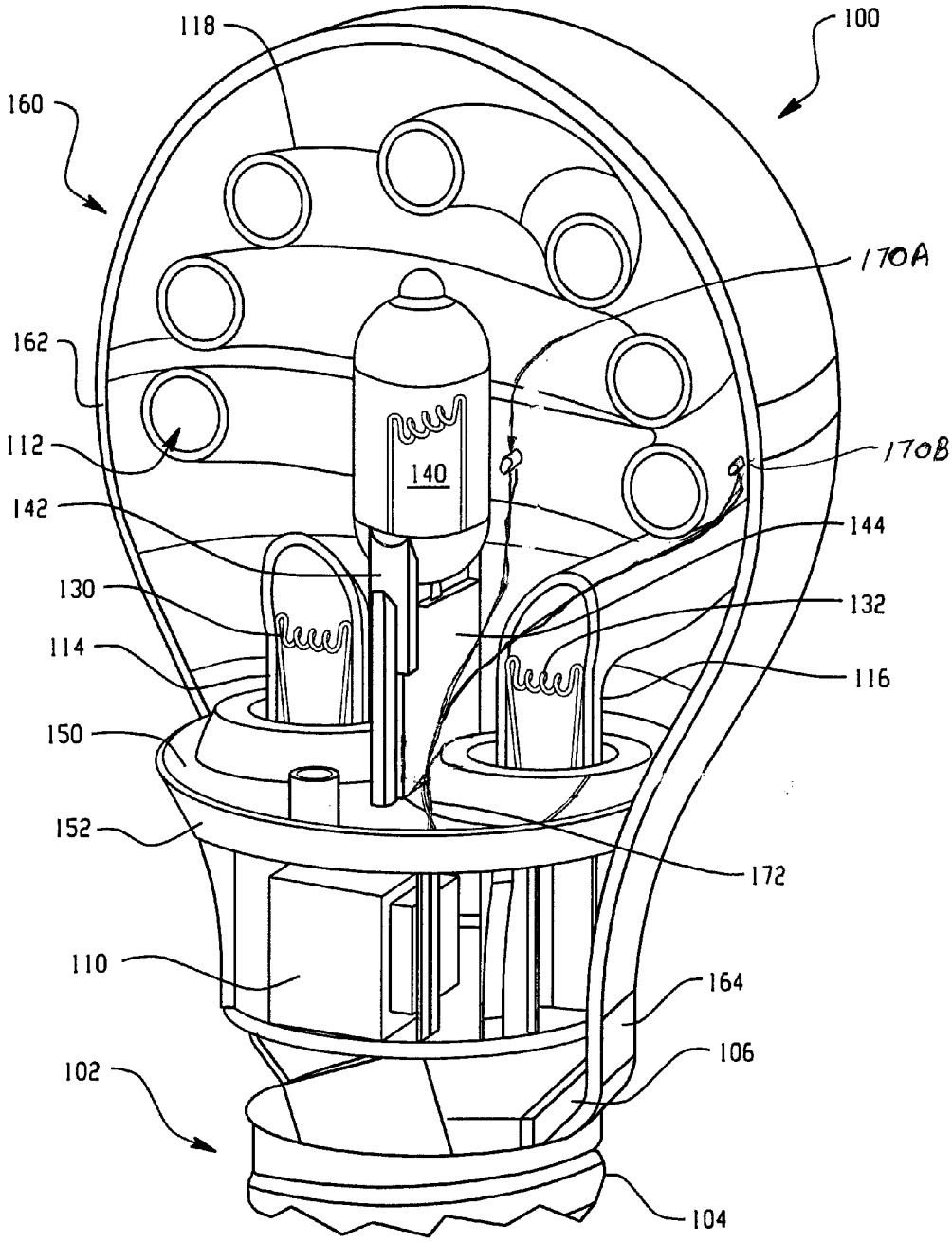
FIG. 2 is an enlarged view of the lamp assembly shown in partial cross-section.

FIGS. 1 and 2 show a lamp assembly 100, and more particularly a combination of a discharge or preferably a fluorescent lamp source such as compact fluorescent lamp (CFL) assembly (that is generally referred to herein as an energy saving lamp or light source) and a secondary light source such as an incandescent lamp assembly that advantageously provides instant light. A lamp base 102 includes a mechanical and electrical arrangement for receipt in an associated lamp socket (not shown) to mechanically support the lamp assembly 100 and provide power to operate the lamp assembly. More particularly, and without need to be limiting, a conventional Edison-base 102 is shown that includes a conductive, threaded metal shell 104 for threaded receipt in an associated lamp socket, and typically includes an electrical eyelet or second contact (not shown) spaced from the threaded shell 104 by insulating material at the lower end of the lamp assembly. This arrangement provides a two lead arrangement for establishing electrical contact associated with the lamp socket in a manner generally known in the art. Of course, one skilled in the art will appreciate that alternative lamp socket arrangements may be used without departing from the scope and intent of the present disclosure, such as a two-pin lamp base arrangement.

At least a portion of the lamp base forms a compartment or inner cavity 106 that receives a power control module 110 such as a ballast mounted on a printed circuit board that allows an AC source to drive the lamp sources or light emitting components of the lamp assembly 100. For example, a ballast is typically enclosed within a portion of compartment 106. Mounted to the lamp base is a first or efficient lamp source such as a fluorescent lamp source 112. The illustrated fluorescent lamp source is preferably a compact spiral configuration or double-helix CFL arrangement that includes first and second legs 114, 116 that have lower portions extending in substantially parallel relation to a longitudinal axis of the lamp assembly. The legs are disposed adjacent the power control module or ballast in order to provide ease of connection of the primary, CFL lamp source with the associated electronics. Intermediate the first and second legs 114, 116, a remainder of discharge tube 118 adopts a generally spiral configuration of the compact fluorescent lamp source. A fill gas is sealed within the discharge tube, and electrodes or cathodes 130, 132 are provided in the respective legs 114, 116, and located at opposite ends of an elongated discharge path that extends through the length of the spiral discharge tube. As is known in the art, an arc is initiated between the cathodes and light emitted from the ionized fill is emitted as visible light in a desired color by passing through a phosphor provided on an inner surface of the discharge tube. Although the fluorescent lamp is shown and described as a spiral or helical-type CFL, one skilled in the art will recognize that other configurations of the fluorescent lamp may be used without departing from the scope and intent of the present disclosure.

A secondary or instant light lamp source 140, such as an incandescent lamp source having a filament (not shown), is also mounted to the lamp base. In another preferred arrangement, the second lamp source is a tungsten halogen lamp. As illustrated in FIGS. 1 and 2, the incandescent lamp source is a single ended light source that is centrally located within a hollow interior region formed within the spiral portion of the CFL in the preferred arrangement. Particularly, base region or leg 142 of the incandescent lamp source 140 is received in a support 144 that extends from a shield or barrier 150 that separates the compartment of the lamp base that houses the power control module from the light emitting portions of the first and second lamp sources 112, 140.

The lamp sources are also preferably housed or enclosed within a common envelope or outer bulb 160. The bulb 160 is dimensioned to enclose the CFL source 112 and the incandescent lamp source 140 within its hollowed, generally spherical portion 162 and the bulb has a reduced dimension as it proceeds toward sealed engagement with the lamp base along a necked-down region 164. Preferably, the shield 150 is located within this transition region between the spherical portion 162 and the necked-down region 164 of the bulb and the shield 150 advantageously protects heat sensitive components of the power control module 110 from the elevated temperatures associated with operation of the first and second lamp sources 112, 140. A perimeter portion 152 of the shield 150 abuts against the inner surface of the bulb 160, while selected openings through the shield permit the electrical connections between the legs of the CFL source 112 and the incandescent lamp source 140 with the power control module.

First and second detectors or sensor members or switches 170A, 170B are disposed in the envelope to monitor a temperature of the lamp assembly (and particularly the CFL as will be described below) in order to determine when to shut off or terminate electrical power to the incandescent lamp source. Particularly, the sensor members 170A, 170B are thermal sensors that monitor a temperature in the lamp assembly or envelope adjacent the particular thermal sensor. More particularly, in one embodiment, the first and second thermal sensors are located at opposite ends of the lamp assembly (FIG. 1). Thus, one of the first and second thermal sensors 170A is located at a first or upper end of the lamp assembly and the second thermal sensor 170B is located near a second or base end of the lamp assembly. In some instances, the second thermal sensor is located in the envelope adjacent the legs of the fluorescent lamp or may be positioned adjacent the ballast of the control module of the lamp assembly.

In an alternative arrangement, the first thermal sensor 170A is located adjacent a central region of the fluorescent lamp source, and is thus preferably positioned adjacent the discharge tube wall 118 in an area spaced from the first and second ends, and likewise spaced from the cathodes 130, 132 (FIG. 2). The second thermal sensor 170B is located at a spaced location in the lamp assembly, and particularly in this embodiment the second thermal sensor 170B is located adjacent the wall of the outer envelope of the lamp assembly. These are not the only locations that the pair of spaced apart thermal sensors may be located within the envelope, and the disclosure is not deemed to be limited to these illustrated embodiments.

In still other arrangements, the specific locations of the first and second thermal sensors within the lamp assembly may vary, and generally the locations are not deemed to be a limiting feature of the present disclosure. However, it is recognized that the natural thermal distribution will differ at different positions of the lamp (horizontal, base up, or base down orientations, for example), and therefore using two thermal switches at two different parts or locations of the lamp or at the two ends of the lamp can provide a more accurate assessment regarding whether the primary/fluorescent lamp has reached a desired level of light output so that the secondary/incandescent lamp operation can be terminated.

In one arrangement, the sum of the first and second thermal sensors is used. That is, the sum of the temperatures are added together from the first and second thermal sensors and, once the combined temperatures or sum reaches a preselected level (indicative of a desired light output from the fluorescent lamp), the control module will terminate electrical power to the incandescent lamp. Without limiting the present disclosure, in a base up position, the first thermal sensor located adjacent the ballast (could be at about 110° C.) or near the cathode (could be at approximately 147° C.), while at the top of the bulb the second thermal sensor may be at approximately 87° C. Therefore, the sum of the temperatures is about 197° or about 230° C., and this threshold sum is used as the level to terminate power to the incandescent lamp.

In a base down orientation, the first thermal sensor (adjacent the ballast/cathode) may reach approximately 123° C. while the second thermal sensor at the end of the envelope opposite the base reads approximately 107° C. and the sum is 230° C. whereby the power to the incandescent lamp is terminated.

Alternatively, the difference between the first and second thermal sensors may be used to determine a threshold level. Again, by way of example only, and not to be deemed limiting, an approximate 50° difference between the first and second thermal sensors may indicate that the compact fluorescent lamp has reached a desired level of light output (87° C. at the top and 140° C. at the base) or if inverted (67° C. at the top of the envelope and 120° C. at the base).

The incandescent lamp source 140 provides an instant light type of light source when power is switched on to the lamp assembly 100. Moreover, the incandescent lamp source heats up both the mercury reservoir and the entire discharge vessel of the energy saving type of light source or compact fluorescent lamp source 112. The heat from the incandescent light source results in a faster evaporation of the mercury from the mercury reservoir into the discharge vessel. Thus, upon switching on the lamp assembly, power is provided to both of the light sources. The incandescent lamp source 140 provides instant light and also provides desired heat to warm-up the fluorescent lamp source 112. Once the fluorescent lamp source is ignited, the heat also aids in the faster evaporation of the mercury and reduces the run-up time to a full light or steady state operation of the fluorescent lamp source 112. As is known in the art, initial ignition or start up of the fluorescent lamp results in greater light output at the first and second ends of the CFL. Once the light output of the compact fluorescent lamp source 112 reaches a predetermined value, an overall energy savings is improved by switching off power to the incandescent lamp source 140.

As noted above, the time to full light operation depends on how fast the glass discharge body reaches an optimal temperature where enough mercury can evaporate to the discharge vessel. Once the discharge vessel has warmed up and full light output is provided as evidenced by either a temperature sum level or a temperature difference level from the first and second thermal sensors, sufficient light output from the discharge lamp will have been achieved, and the instant light or incandescent light source 140 is no longer needed to provide a certain percentage of the lumen value for the lamp assembly. As is known, the incandescent lamp source reaches its lumen value and a steady state condition immediately. Therefore, the combination of the incandescent lamp and the CFL provides desired instant-on light and long term energy efficiency and energy savings.

Whereas a compact fluorescent lamp typically requires 20 to 120 seconds or more to reach the full light condition, the lamp assembly 100 of the present disclosure has an instant light feature of the incandescent lamp source 140 and a run-up time to full light of the compact fluorescent lamp source 112. Energy savings is still achieved as a result of switching off the incandescent lamp source once the discharge tube has reached the predetermined value of light output as monitored along the central region of the CFL lamp by the thermal sensors 170A, 170B.

Both light sources are preferably located within the common outer bulb 160. This allows the arrangement to achieve the shortest warm-up period by reducing the loss of heat to the external environment. The stabilization of the primary light source can be sensed by the thermal output of the CFL, and so the thermal sensors can sense if the primary light source is at a desired temperature level that is likewise indicative of a desired light output.

The disclosure has been described with respect to preferred embodiments. Obviously, modifications and alterations may be contemplated by one skilled in the art, and the subject disclosure should not be limited to the particular examples described above but instead through the following claims.

What is claimed is:

1. A lamp assembly comprising:

a lamp base having a compartment;

an elongated discharge light source;

a separate, second light source disposed adjacent to the discharge light source;

an envelope mounted to the lamp base and forming a cavity around at least the discharge and second light sources;

a power control module received in the lamp base compartment and operatively connected to the discharge and second light sources; and first and second thermal detectors disposed in the envelope at different locations for sensing operation of the discharge light source and operatively communicating with the power control module.

2. The lamp assembly of claim 1 wherein the first and second detectors are thermal sensors.

3. The lamp assembly of claim 1 wherein the first and second detectors are thermal switches that aid in determining when to turn off the second light source.

4. The lamp assembly of claim 3 wherein the first and second thermal switches are thermistors.

5. The lamp assembly of claim 3 further comprising a controller that is responsive to a sum of the temperatures provided by first and second thermal switches to determine when the discharge light source reaches a preselected light output.

6. The lamp assembly of claim 5 wherein the first and second thermal switches are located at first and second ends of the discharge light source.

7. The lamp assembly of claim 5 wherein the lamp assembly operates in a base up orientation.

8. The lamp assembly of claim 7 wherein the first detector is located near the base and the second detector is located remote the base.

9. The lamp assembly of claim 5 wherein the lamp assembly operates in a base down orientation.

10. The lamp assembly of claim 5 wherein the lamp assembly operates in a substantially horizontal orientation.

11. The lamp assembly of claim 5 wherein the thermal switches are thermistors that provide an increasing electrical signal in response to detecting an increase in temperature.

12. The lamp assembly of claim 1 wherein the lamp assembly operates in a base up orientation, the first detector is located adjacent a ballast, and the second detector is located at an end of the envelope remote from the ballast.

13. The lamp assembly of claim 1 wherein the first detector is located at one end of the envelope, and the second detector is located at a second end of the envelope, and the sum of the two temperatures is monitored so that the second light source is terminated at a predetermined temperature sum.

14. The lamp assembly of claim 1 wherein the first detector is located at one end of the envelope, and the second detector is located at a second end of the envelope, and the difference of the two temperatures monitored so that the second light source is terminated at a predetermined temperature difference.

15. The lamp assembly of claim 14 wherein the first detector is located in a middle region of the envelope and the second detector is disposed adjacent an outer surface of the lamp envelope.

16. A method of operating an energy saving lamp assembly comprising:

providing a fluorescent lamp source;

positioning a second lamp source adjacent the fluorescent lamp source;

enclosing the fluorescent lamp source and the incandescent lamp source in an envelope;

using first and second thermal switches disposed at different first and second locations in the envelope to monitor temperature in the envelope; and selectively terminating power to the second lamp source in response to the thermal sensors reaching a predetermined value indicative of light output from the fluorescent lamp source.

17. The method of claim 16 wherein the power terminating step is based on a predetermined value of a sum of the temperatures detected by the first and second thermal sensors.

18. The method of claim 16 wherein the power terminating step is based on a predetermined value of a difference of the temperatures detected by the first and second thermal sensors.

19. The method of claim 16 wherein the first and second thermal switches are located at opposite ends of the lamp envelope.

20. The method of claim 16 wherein the first of thermal switch is located in a middle portion of the lamp envelope and the second thermal switch is located adjacent a surface of the envelope.

* * * * *